US011492828B2

(12) United States Patent
Hoffmann et al.

(10) Patent No.: US 11,492,828 B2
(45) Date of Patent: Nov. 8, 2022

(54) DOOR HOLDER

(71) Applicant: Edscha Engineering GmbH, Remscheid (DE)

(72) Inventors: Peter Hoffmann, Overath (DE); Gundolf Heinrichs, Remscheid (DE); Torsten Meissner, Remscheid (DE); Dietmar Rehborn, Remscheid (DE)

(73) Assignee: EDSCHA ENGINEERING GMBH, Remscheid (DE)

( * ) Notice: Subject to any disclaimer, the term of this patent is extended or adjusted under 35 U.S.C. 154(b) by 1027 days.

(21) Appl. No.: 16/092,545

(22) PCT Filed: Apr. 12, 2017

(86) PCT No.: PCT/DE2017/100302
§ 371 (c)(1),
(2) Date: Oct. 10, 2018

(87) PCT Pub. No.: WO2017/178018
PCT Pub. Date: Oct. 19, 2017

(65) Prior Publication Data

US 2019/0169894 A1 Jun. 6, 2019

(30) Foreign Application Priority Data

Apr. 13, 2016 (DE) ..... 102016106826.8

(51) Int. Cl.
*E05C 17/44* (2006.01)
*E05C 17/20* (2006.01)

(52) U.S. Cl.
CPC ..... *E05C 17/446* (2013.01); *E05C 17/203* (2013.01); *E05C 17/206* (2013.01); *E05Y 2201/21* (2013.01); *E05Y 2900/132* (2013.01)

(58) Field of Classification Search
CPC .... E05C 17/446; E05C 17/203; E05C 17/206; E05Y 2201/21; E05Y 2900/132; Y10T 16/61
See application file for complete search history.

(56) References Cited

U.S. PATENT DOCUMENTS 9,346,341 B2 * 5/2016 Ziegler ..... B60J 5/0455
9,447,623 B2 * 9/2016 Murayama ..... E05C 17/206
(Continued)

FOREIGN PATENT DOCUMENTS

CN 101652526 A 2/2010
CN 204418855 U 6/2015
(Continued)

OTHER PUBLICATIONS

Corresponding PCT International Search Report.
International Preliminary Report on Patentability for corresponding PCT application.

*Primary Examiner* — Victor D Batson
*Assistant Examiner* — Matthew J Sullivan

(57) ABSTRACT

A door holder, includes a retainer housing (230), which can be connected either to a door or a door frame, and a door retainer rod, which penetrates the retainer housing (230) and which can be articulated to the other of the door and the door frame The door retainer rod has at least one braking surface, and at least one braking element (50) that can be displaced toward the at least one braking surface is arranged on the retainer housing (230), which the braking element can be brought in contact with the at least one braking surface of the door retainer rod at least in some sections and thus produces a primary braking force component against the displacement of the door retainer rod, wherein the door retainer rod has at least one guiding surface, which is inclined with respect to the braking surface. A door holder that provides high holding forces at least in some sections is created in that at least one
(Continued)

guiding element (235*a,* 235*b*) is arranged on the retainer housing (230), which the guiding element can be brought in contact with the at least one guiding surface at least in some regions and produces a secondary braking force component against the displacement of the door retainer rod.

18 Claims, 10 Drawing Sheets

(56) References Cited

U.S. PATENT DOCUMENTS

| | | | | |
|---|---|---|---|---|
| 2003/0037411 | A1* | 2/2003 | Seo | E05C 17/206 16/86 C |
| 2003/0051312 | A1* | 3/2003 | Hoffmann | E05C 17/203 16/50 |
| 2003/0163895 | A1* | 9/2003 | Liang | E05C 17/203 16/82 |
| 2010/0154163 | A1* | 6/2010 | Hoffmann | E05C 17/203 16/85 |
| 2015/0352931 | A1 | 12/2015 | Ziegler et al. | |
| 2018/0335078 | A1* | 11/2018 | Andersson | F16C 29/005 |
| 2019/0376327 | A1* | 12/2019 | Hertel | E05B 15/1635 |
| 2021/0131141 | A1* | 5/2021 | Rossi | E05C 17/24 |
| 2021/0164276 | A1* | 6/2021 | Hoffmann | E05C 17/163 |

FOREIGN PATENT DOCUMENTS

| | | | |
|---|---|---|---|
| CN | 105275289 | A | 1/2016 |
| DE | 102004034259 | A1 | 2/2005 |
| DE | 102010051250 | A1 | 5/2012 |
| DE | 10 2014 108023 | A1 | 12/2015 |
| DE | 102014108023 | | 12/2015 |
| GB | 948797 | A | 2/1964 |
| JP | H0649129 | U | 7/1994 |
| JP | H11 303487 | A | 11/1999 |
| JP | H11303487 | A | 11/1999 |
| JP | 2000039006 | A | 2/2000 |
| JP | 2003301650 | A | 10/2003 |
| KR | 10-2003-0039750 | | 5/2003 |
| KR | 10-2006-0062515 | | 6/2006 |
| KR | 10-0921072 | | 10/2009 |
| WO | WO 0190518 | A1 | 11/2001 |

* cited by examiner

DOOR HOLDER

The invention relates to a door holder.

BACKGROUND

WO 01 90 518 A1 describes a door holder comprising a retainer housing, which is connectable to either a door or a door frame, and a door retaining rod, which penetrates the retainer housing and can be articulated with the other of door and door frame. The door retaining rod has two braking surfaces facing away from one another, and two braking elements each displaceable in the direction of one of the braking surfaces are arranged in the retainer housing, which braking elements can be brought into contact with the braking surface of the door retaining rod and jointly generate a primary brake force component against the displacement of the door retaining rod. Furthermore, the door retaining rod has at least one guide surface, which is inclined at a right angle in relation to the braking surface and does not have profiling.

GB 948 797 A describes a door holder comprising a retainer housing, which is connectable to either a door or a door frame, and a door retaining rod, which penetrates the retainer housing and can be articulated with the other of door and door frame. The door retaining rod has two braking surfaces facing away from one another and is widened in some regions.

DE 10 2004 03 4259 A1 describes a door holder, which is used for provisionally fixing the side door of a motor vehicle, in particular for dip painting, comprising a retainer housing, which is connectable to the door, and a door retaining rod, which penetrates the retainer housing and can be articulated with the door frame, wherein the door retaining rod has a braking surface on its narrow sides, wherein two metallic spring wire sections are provided on the retainer housing, each of which can be brought into contact with the braking surfaces of the door retaining rod and thus generate a primary brake force component against the displacement of the door retaining rod. The two spring wire sections are fixed in this case on the housing. The known door holder has the disadvantage, on the one hand, that the application of the spring wire sections directly to the narrow side of the retaining rod tends to generate noise, whereby the operating comfort of the door holder is greatly restricted. Furthermore, the spring wire sections tend toward corrosion because of the exposed position thereof. Finally, the applied retaining forces are comparatively low, because of which the door holder is not very suitable for use in regular vehicle construction.

DE 10 2010 051 250 A1 describes a door holder in which a retaining rod penetrates a retainer housing, wherein a seal arrangement is provided on the retainer housing, which has two lobes, which can be brought into contact with two surfaces of the door retaining rod to form a seal, wherein the seal arrangement is compressible.

DE 10 2014 108 023 A1 describes a door holder for a motor vehicle, comprising a retainer housing, which is connectable to a door, wherein the retainer housing is penetrated by a door retaining rod which can be articulated with the door frame, wherein the door retaining rod has a braking surface on each of its two wide sides, wherein axially displaceable braking elements, which are each pretensioned by a spring in the direction of the braking surfaces, are arranged on the retainer housing, which braking elements can be brought into contact with the corresponding braking surface of the door retaining rod and generate a primary brake force component against the displacement of the door retaining rod. The door retaining rod furthermore has two guide surfaces inclined in relation to the braking surface, wherein protruding and recessed sections are provided on the guide surfaces, which correspond with respect to effect to the protruding and recessed sections on the braking surfaces. Two spring elements extending parallel to the displacement direction of the braking elements are arranged on the retainer housing, which come into contact around the circumference with the guide surfaces facing toward them and generate a secondary brake force component against the displacement of the door retaining rod. The spring wire sections are arranged in this case in the region of an opening of the retainer housing, which is connected downstream of the movement axis of the braking elements, and therefore the risk of torques and tilting exists. Furthermore, the spring wire sections are guided through additional openings through the housing and have to be anchored on plate bodies, which are attached to the housing, whereby the housing of the door holder reaches a large structural height overall. The spring wire sections are arranged at a point in the retainer housing which is difficult to access in particular in the installed state, and therefore maintenance and cleaning are difficult. Furthermore, the spring wire sections tend toward corrosion. Finally, the spring wire sections are deformed with respect to the retainer housing, and therefore quite large travels result to generate a secondary brake force component.

SUMMARY OF THE INVENTION

It is an object of the invention to specify a door holder which provides high retaining forces at least in some sections.

A door holder is provided that includes a retainer housing, which is connectable to either a door or a door frame, and a door retaining rod, which penetrates the retainer housing and can be articulated with the other of door and door frame. In this case, the door retaining rod has at least one braking surface, wherein at least one braking element displaceable in the direction of the at least one braking surface is arranged on the retainer housing, which can be brought into contact at least in some sections with the at least one braking surface of the door retaining rod and thus generates a primary brake force component against the displacement of the door retaining rod. The door retaining rod furthermore has at least one guide surface inclined in relation to the braking surface, wherein the door holder is distinguished in that at least one guide element is arranged on the retainer housing, which guide element can be brought into contact at least in some regions with the at least one guide surface and generates a secondary brake force component against the displacement of the door retaining rod.

Due to the provision of a secondary brake force component, which assists the primary brake force component, it is possible to achieve higher retaining forces for the door retaining rod and thus for the door than is possible using door holders from prior art. In this case, the secondary brake force component can be less, greater, or the same amount as the primary brake force component. The secondary brake force component is preferably not greater than the primary brake force component, however, and is particularly preferably not greater than half of the primary brake force component. The primary brake force component is substantially achieved by pressing back the spring-loaded braking elements, which are tensioned strongly or less strongly using the corresponding section in dependence on its thickness. In this case the corresponding section can be elevated quite significantly in relation to the starting position, since it is possible to form the sections on the braking surfaces of the retaining rod having corresponding thicknesses. The opening is then to be provided as correspondingly high.

The primary brake force component is defined as the total of all brake forces which were generated between braking elements and braking surfaces, while the secondary brake force component is defined as the total of all brake forces which were generated between guide elements and guide surfaces.

The door holder according to the embodiments of the invention is designed as lightweight and compact and does not occupy a larger installation space than the door holders from prior art. In particular, it is possible to form the door retaining rod of the door holder as narrow, and therefore a force enhancement by a further braking element which acts on the same braking surface is not required.

The retaining rod therefore advantageously enables the primary brake force component and the secondary brake force component to be set independently of one another by the embodiment of the door retaining rod and opens up new embodiment options for the design of the retaining force curve of the door by superimposing or adding the two brake force components. Thus, for example, the one of guide surface and braking surface can define catch depressions at specific intervals, while the other of guide surface and braking surface sets a continuously rising or falling brake force. It is therefore possible that sometimes the primary brake force component and sometimes the secondary brake force component achieves a greater proportion of the brake force resulting from the total of the two brake force components. It is furthermore possible to select the material composition or the roughness in the region of the guide surface and the braking surface differently, in order to accordingly influence the coefficients of friction incorporated into the brake force component.

The braking elements are expediently axially displaceable in a borehole and can thus execute quite a large stroke. The pre-tensioning of the braking elements is expediently carried out in each case by a separately assigned spring.

The number of braking surfaces and the number of guide surfaces is expediently equal in a door holder, and therefore two braking surfaces are also provided in the case of two guide surfaces. However, it is possible to provide the number of the guide surfaces and the number of the braking surfaces in different amounts, for example, if the door retaining rod has a hexagonal profile in cross section, and one of the opposing pairs, in particular the wide sides, each form a braking surface, while the four remaining edges form guide surfaces. According to an alternative embodiment, it can also be provided that the retaining rod has a triangular profile in cross section, wherein the upper side forms the braking surface, and the two further surfaces enclosing an angle with the upper side define guide surfaces. However, it is preferable for the braking surfaces and the guide surfaces to enclose a right angle with one another, and therefore practically no components of the forces acting on a braking surface and a guide surface act in opposition.

The door retaining rod preferably has two braking surfaces facing away from one another in a pair and two guide surfaces facing away from one another in a pair and is, for example, equipped with a rectangular profile in cross section. Accordingly, the retainer housing also has two braking elements facing toward one another in a pair and two guide elements facing toward one another in a pair in a preferred embodiment. The axially movable braking elements are advantageously also arranged in this case on the same movement axis, while there are various options for the arrangement of the guide elements.

Each of the two braking surfaces can expediently be brought into contact with a braking element, respectively, and each of the two guide surfaces can be brought into contact with a guide element, respectively. Whether a contact takes place is dependent on the local composition of the door retaining rod, which is displaceable back and forth in an opening of the retainer housing.

According to one preferred embodiment, it is provided that the at least one braking element is pre-tensioned by a spring in the direction of the at least one braking surface, and the at least one braking surface has a height profile extending unevenly in height over the course of the door retaining rod, wherein with increasing height of the height profile, the spring of the at least one braking element is tensioned. The spring will generally have quite a high spring stiffness, which has the result that in the case of tensioning of the spring, the resulting primary brake force component is quite high.

The at least one braking element is preferably pre-tensioned by a spring in the direction of the at least one braking surface, and therefore the braking element can execute an axial stroke when it travels over sections of the braking surface which have a sufficiently large height that the spring is tensioned.

The at least one braking surface preferably has a height profile extending unevenly in the height over the course of the door retaining rod, which can contain both sections in which the spring is tensioned and also those in which the spring is relaxed. In this way, the primary force component can be influenced particularly favorably by the selection of the height profile and/or the embodiment of the corresponding sections of the braking surface. The spring is increasingly tensioned with increasing height of the height profile.

According to one preferred embodiment, it is provided that two opposing guide elements are arranged on the retainer housing, which guide elements can each be brought into contact at least regionally with two guide surfaces facing away from one another of the retaining rod, and the two guide surfaces have an oversize in relation to the two guide elements at least in one region. In order to move the guide surfaces equipped with the oversize past the guide elements, it is necessary to introduce a higher force into the system of the retainer housing, whereby either a pre-tensioning unit loading the guide elements is reset or the entire system of the retainer housing is deformed in such a way that the retaining rod may be moved. A secondary brake force component may be generated particularly cost-effectively in this way, in particular if no separate spring arrangement is provided for the guide elements.

According to one particularly preferred first embodiment, it is provided that the guide element is formed in each case as a pin, wherein the pin is accommodated in a guide part of the retainer housing. The pin provides a part of its outer contour for the engagement with the guide surface and is moreover retained in the guide part. In this way, the quite inelastic pin also transfers forces from the guide surface into the retainer housing.

According to a first variant, an end face of the pin protrudes into the opening of the retainer housing or at least delimits it. The end face is then intended for contact with the respective associated guide surface, wherein the transition from the end face to the cylindrical lateral surface of the pin can be rounded in order to facilitate the running in. In this case, the pin can have a diameter which approximately corresponds to the minimum thickness of the retaining rod, and therefore the surfaces coming into contact with one another are maximized. The embodiment of the guide element as a pin, which protrudes axially into the opening, furthermore offers the advantage that the pin can be embodied having a crowned tip having a flat, central part, which does not have an excessively large diameter, and therefore the further function of the guide elements, namely effectuating a certain curve guiding of the curved door retaining rod, is interfered with less. If the pin is provided axially in the direction toward the opening, it is preferably formed as a solid material pin, since the end face then provides a large surface to interact with the guide surface sliding partner.

The pin is expediently pressed into a corresponding borehole of the guide part of the retainer housing, but can also be screwed, adhesively bonded, or otherwise inserted in a formfitting manner therein.

According to another cost-effective alternative, the pin can also be injection molded into the corresponding guide part of the retainer housing if it is produced in the injection molding method. The extremities of the pin are then expediently flush with the guide part, and therefore the pin does not protrude into the opening, but delimits it at the height of the retaining rod.

According to another variant, it is provided that a radial circumferential surface of the pin protrudes into the opening or at least delimits the opening. The part of the pin facing radially toward the door retaining rod, in general a circumferential section, then comes into contact with the guide surface in order to brake the retaining rod. According to a first preferred implementation, the pin is formed from a solid material and is then connected in a formfitting manner to or injection molded with the guide part of the retainer housing. However, it is also possible to insert the pin into a recess, and then to secure it with a stud which penetrates the pin. The circumferential contour of the pin can be selected as desired, but is preferably polygonal to prevent twisting in the corresponding receptacle of the retainer housing and at the same time provide a contour adapted to the guide surface. However, it is also possible to form the pin having a round circumferential contour, which ensures favorable running of the retaining rod into the opening, in particular of ramps provided on the guide surface.

According to an alternative embodiment, it is provided that the guide element is attached to the retainer housing as a panel or as a panel part, which is preferably pre-tensioned elastically in its starting position. In this case, the guide element can be equipped with a strut, which is accommodated in the retainer housing, for example, doweled or clipped, on its side facing away from the guide surface of the retaining rod. Alternatively, the panel can also be adhesively bonded onto the corresponding part of the retainer housing. Finally, the panel can also be insert molded onto the side of the guide part of the retainer housing delimiting the opening. The special advantage of the embodiment as a panel is that it guides the retaining rod favorably in the direction toward the opening and is also quite insensitive to soiling.

According to one expedient embodiment, the guide element is formed as a surface region formed with a guide part of the retainer housing, and therefore the guide element is not to be connected as a separate part to the guide part, but rather the surface region forming the guide element is provided on the engagement surface of the guide part. In this way, the retainer housing can hardly be externally differentiated from a retainer housing from prior art. The retainer housing thus embodied can also be used in vehicles which have a door retaining rod, which does not have a region equipped with oversize, and therefore the corresponding retainer housing can be installed frequently. In relation to the guide element embodied as a pin, this variant is comparatively simple to produce. At least the surface region is formed free of fiber reinforcements in this case. The surface region advantageously comprises, with a lesser thickness, the saddle region of the guide part facing toward the guide surfaces. The surface region advantageously extends over the entire height of the opening, but it is possible to provide it only in a middle region of this height. The surface region, which is preferably formed from polyether ether ketone, can be connected to the guide part by insert molding a solid part, or also by selective coating or heat treatment using a laser. In the case of insert molding or injection molding, the ends of the surface region advantageously also extend into the region of the housing parts guiding the braking elements and are advantageously anchored in this way.

The guide element is preferably tensioned against the guide surface. The tensioning alternately takes place due to the intrinsic tension of the guide element if it is formed, for example, as a thin-walled panel part or as a load base. Alternatively or additionally, the retainer housing, which is deformable per se, tensions the guide element attached to the retainer housing, in particular a guide part of the retainer housing, and thus generates the pre-tension of the guide element in the direction toward the guide surface. If the guide surface is displaced along the guide element, the guide element is shifted or deflected, and therefore the retaining rod dimensioned with oversize is displaceable past the guide elements.

According to a favorable embodiment, it is provided that studs made of steel or an elastic material are accommodated in the retainer housing, which load the guide parts having the guide elements in the direction toward the retaining rod. The studs can be accommodated in boreholes, which are embodied slightly diagonally, for example, of the further parts of the retainer housing and can thus have a bulge or pre-tension in the direction toward the opening.

According to a cost-effective modular embodiment, it is provided that the guide element is provided on a separate guide part of the retainer housing, and that the separate guide part can be assembled with further individual parts of the retainer housing to form the retainer housing. In this way, it is advantageously possible to arrange the guide element on or in the guide part already before it is installed, which enhances the installation friendliness of the retainer housing as a whole. Furthermore, the retainer housing can thus substantially be assembled from two guide parts and two housing parts accommodating the braking elements, and therefore a low variety of parts is provided.

The retainer housing is preferably enclosed by a reinforcement frame which is circumferential, or at least encloses three sides of the retainer housing, and which somewhat absorbs the forces transmitted from the guide surfaces of the retaining rod to the guide elements and thus the retainer housing and avoids a fracture or damage of the retainer housing. The retainer housing reinforces for this purpose in particular the region of the connection of the guide parts to further housing parts.

In a further embodiment, it is advantageously provided that the further housing parts have bolts, which at least partially penetrate the guide parts and thus limit the movement thereof from the opening. In this way, the fracture-sensitive region of the transition from the further housing parts to the guide parts is advantageously further reinforced. According to a particularly favorable variant, it is provided that the bolts each penetrate the housing from top to bottom and are riveted at least at one end, preferably at both ends, terminally on retaining plates of the housing parts.

The retaining rod as a whole can have arbitrary contours suitable for the purpose of locking the door, and therefore a variety of braking and retaining characteristics of the door are settable. In particular, the retaining rod can contain a metal core and can be equipped with a plastic casing on the guide surfaces and/or the braking surfaces.

The guide elements are preferably formed as sliding sections which are arranged substantially without torque on the retainer housing, wherein the secondary brake force component is then set by the coefficients of friction of the friction pair. In this way, the guide element introduces forces uniformly into the retainer housing and/or its guide parts. Furthermore, the guide elements are preferably not displaceable with respect to the retainer housing, and therefore a longitudinal guide like a borehole does not have to be provided on the retainer housing, whereby forces acting on the guide elements can be introduced directly into the retainer housing. According to an alternative embodiment, it is provided that the guide element is formed as a roller, which is mounted so it is rotatable in a guide part, wherein the roller engages with its roller circumference with the guide surface. The roller circumference can, for this purpose, have a wedge-shaped or U-shaped depression falling toward its center plane, which centers the holding rod with respect to the center of the roller circumference. For this purpose, the roller is expediently mounted on a roller bearing, for example, one of the above-described bolts, wherein the axial displacement introduced from the guide surfaces into the roller is absorbed using the bearing of the roller.

The guide elements are expediently arranged centrally with respect to the height of the opening, and therefore advantageously in the position in which the door retaining rod also runs. However, it is also possible that the guide elements cover the entire height of the opening or substantial parts thereof, and therefore the ends thereof may be countersunk more easily into the retainer housing.

BRIEF SUMMARY OF THE DRAWINGS

Further advantages, refinements, properties, and implementations of the invention result from the following description of preferred exemplary embodiments and from the dependent claims.

The invention will be explained in greater detail hereafter with reference to the appended drawings on the basis of preferred exemplary embodiments.

DETAILED DESCRIPTION

Figure 1:
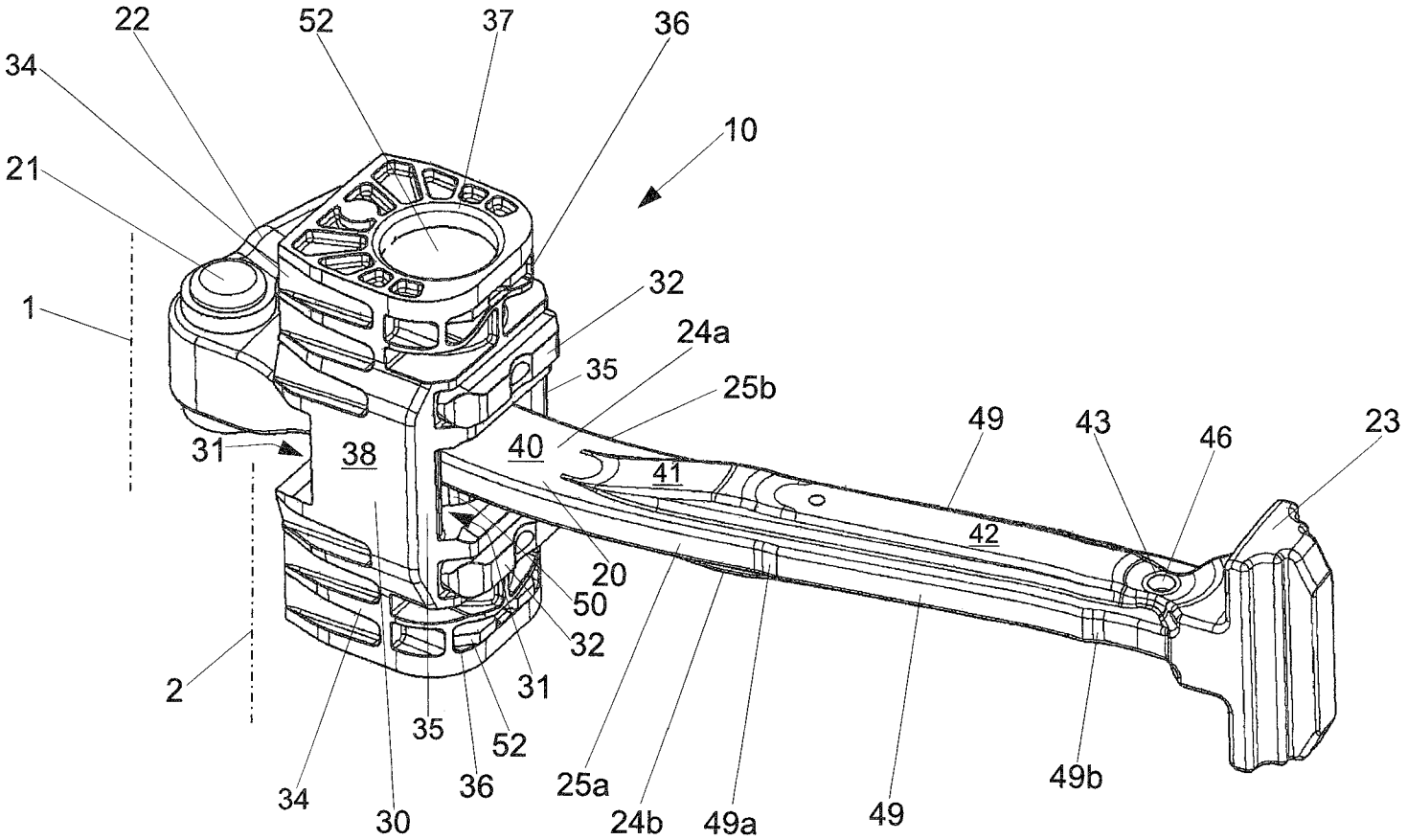
FIG. 1 shows a perspective view of a first preferred exemplary embodiment of a door holder according to the invention.

A door holder 10, which comprises a door retaining rod 20 and a retainer housing 30, is shown in a perspective view in FIG. 1, wherein the retaining rod 20 is articulated via a joint with a fitting 22 for fixing an outwardly facing side of a door frame indicated as a dot-dash line 1 21 having. The retainer housing 30 is attached on an inwardly facing side of the door indicated as a dot-dash line 2 and has a central opening 31, through which the retaining rod 20 is guided. The retainer housing 30 is formed as an injection molded part, which at least partially has a fiber reinforcement made of glass fibers or aramid fibers.

The retaining rod 20 has, on the end facing away from the linkage 21, an end stop 23, which is dimensioned sufficiently large to prevent the retaining rod 20 from being able to slide through the opening 31. When the door is completely opened, the end stop 23 strikes against stop elements 32 of the retainer housing 30, which are arranged on both sides of the opening 31 and accordingly enable a damping of the collision of stop 32 and retainer housing 30 and also a noise reduction.

The retaining rod 20 has a slightly curved shape, which is adapted somewhat to the radius around the hinge axis of door 2 and door frame 1, and therefore the door retaining rod 20 is movable with little effort through the opening 31 of the retainer housing 30. In this case, the part of the door retaining rod 20 which passes through the retainer housing 30 is also accommodated in the interior of the door 2, and therefore the curvature is advantageously flatter than predefined by the radius of the linkage of the door 2, so as not to unnecessarily enlarge the width of the door 2.

The door retaining rod 20 fundamentally has a rectangular cross section, wherein the wide sides facing upward and downward respectively form two elongated braking surfaces 24*a*, 24*b*, while the narrow sides arranged transversely thereto form guide surfaces 25*a*, 25*b* of the retaining rod 20.

The braking surfaces 24*a*, 24*b* can be divided into multiple sections in the course thereof from the linkage 21 to the end stop 23, wherein a first section 40 can be referred to as a free running section or tightening aid, in which the retaining rod 20 can be moved in the retainer housing 30 without resistance in the direction of its extension. A second ramp section 41 is distinguished by ramps arranged on both braking surfaces 24*a*, 24*b*, wherein in the present case one ramp section 41 is shown, but it is to be understood that multiple slopes like a ramp can also be provided in the ramp section 41, including those which rise or fall in the direction toward the stop 23 to form a thicker retaining rod 20 and toward the stop 23 to form a less thick retaining rod 20, respectively. A gripping section 42 adjoins the slope section 41, in which the thickness of the retaining rod 20 is selected such that it is retained with a certain force in the retainer housing 30. Finally, an end section 43 formed with a depression 46 is provided before the stop 23, which defines a retaining position of the door 2 and in which the retaining rod 20 is provided in both directions with slopes increasing in the direction toward a thicker dimension.

The sections 40, 41, 42, and 43 may also be represented in another sequence or with other dimensions, in particular it is possible that the sections extend over the entire width of the braking surfaces 24*a*, 24*b* and not only a part thereof, as shown in FIG. 1. Furthermore, more depressions can be provided in the sections than the depression 46 from end section 43. It is furthermore possible to provide only some of the mentioned sections, or also some sections multiple times. More than the mentioned sections can also be provided.

The sections 41, 42, 43, as will be explained in detail hereafter, generate, with the retainer housing 30, a primary brake force component against the displacement of the door retaining rod 20.

Moreover, it can be seen that over the extension of approximately the gripping section 42, the guide surfaces 25*a*, 25*b* of the retaining rod 20 additionally have a widened region 49, with an inlet 49*a* and an outlet 49*b*. The widened region 49 protrudes on both sides of the guide surfaces 25*a*, 25*b* and has the result that the widened region 49, as explained in greater detail hereafter, generates, with the retainer housing 30, a secondary brake force component against the displacement of the door retaining rod 20.

The retainer housing 30 has two planar surfaces 31*a*, which are arranged opposing in a pair and face toward the braking surfaces 24*a*, 24*b* of the retaining rod 20, and which each delimit one of the housing parts 34 of the retainer housing 30 formed with a central recess 33 (FIG. 2), wherein a braking element 50 and a spring element pre-tensioning it are accommodated in each of the recesses 33. The spring element is supported in this case against an abutment plate 52 inserted into a slot 36 of the housing part 34*a*, 34*b*, and therefore the braking element 50 is pre-tensioned in each case toward the braking surface 24*a*, 24*b* facing toward it. The braking elements 50 have a crowned surface, which is extended from an approximately cylindrical jacket section, wherein the cylindrical jacket section enables an axial displaceability in a borehole 33*a* opening into the recess 33. The cylindrical jacket section is formed hollow, and therefore the spring can be supported in the cylindrical jacket section without the spring being able to cause friction noises with the circumferential wall of the central borehole 33*a*. The spring is formed, for example, as a coiled spring, but it is also possible to provide a cup spring assembly for this purpose. The outer circumferential wall of the cylindrical jacket section has a circumferential fluting extending in the movement direction, wherein furthermore a radially protruding twist lock is formed on the cylindrical jacket section, which cooperates with a longitudinally extending groove in the borehole 33*a* to ensure that the braking element 50 can only move axially.

The retainer housing 30 is produced as a one-piece plastic part, wherein the braking elements 50 and springs are insertable through a central passage 37 provided in the upper and lower end faces facing away from the surfaces 31*a*, wherein after the insertion, the bolt plate 52 is inserted into a slot 36 intersecting the borehole 33*a*. It is possible to already introduce the door retaining rod 20 into the recess 31 upon the insertion of the braking elements 50 and the springs. It is alternatively possible to form the borehole 33*a* as a pocket hole, which does not have a passage 37.

Figure 2:
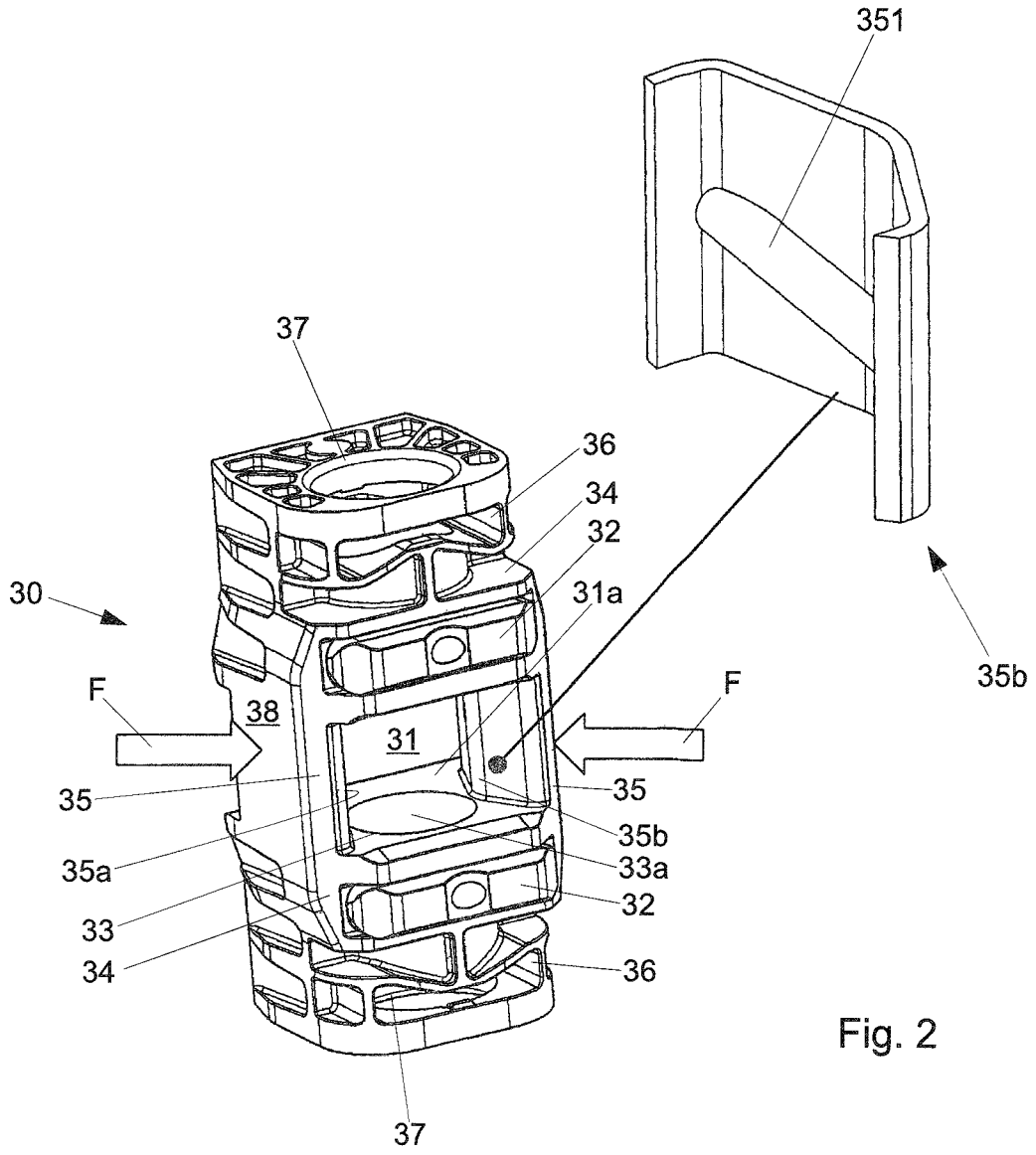
FIG. 2 shows the retainer housing of the door holder from FIG. 1 in a perspective view.

The retainer housing 30 is shown in FIG. 2 without retaining rod 20 and braking elements 50 and also springs and bolt plates 52, to be able to better recognize otherwise concealed details.

The retainer housing 30 is formed mirror-symmetrical with respect to a center plane, through which the retaining rod 20 is also displaceable, and therefore a braking element 50 is arranged in each case both on the upper side and also on the lower side, and these two, jointly with the braking surfaces 24*a*, 24*b* facing toward them, generate a primary brake force component against the displacement of the door retaining rod 20 when the retaining rod 20 is displaced along the braking elements 50 to which the springs are applied. This is the case above all in the sections 41, 42, 43, while the thickness of the retaining rod 20 defined by the distance of the braking surfaces 24*a*, 25*a* in the freewheel section 40 is dimensioned such that no or practically no contact is provided with the braking elements 50, and therefore the door 2 can slide into the door lock even upon application of a lesser force.

The two housing parts 34 are connected to one another via two guide parts 35 of the retainer housing 30, which are arranged in a mirror image with respect to a vertical plane and on both sides of the opening 31, and in the region of which the outer wall 38 of the retainer housing 30 is embodied flat. The guide parts 35 are formed in the present exemplary embodiment like a saddle roof, and therefore the vertex of the saddle extends approximately at the height of the opposing recesses 33 or the center axis of the boreholes 33*a*. It is ensured in this way that the retaining rod 20 is guided between the two guide parts 35 in the region of the braking elements.

In the present exemplary embodiment, a guide element 35*a*, 35*b* formed as a panel part, which is formed as a thin-walled clamp and which also has a shape like a saddle roof (FIG. 2), is clipped in each case in the region of the saddle of the guide parts 35. On the rear side, the clamp has a web 351, which is intended to be clipped into a corresponding groove of the guide part 35. The guide elements 35*a*, 35*b* are formed for this purpose as somewhat elastic and thus yielding, having the side thereof pointing outward facing toward the guide surfaces 25*a*, 25*b*, and guide these guide surfaces at an angle of 90° in the present case to the braking elements through the opening 31. The distance of the guide elements 35*a*, 35*b* is greater in this case than the width of the holding rod 20 outside the region 49, which is measurable as the distance of the two guide surfaces 25*a*, 25*b*. In the region 49, in contrast, the width of the retaining rod 20 is greater than the distance of the outer surfaces facing toward one another of the guide elements 35*a*, 35*b*, and therefore whenever the section 50 comes into contact with the guide elements 35*a*, 35*b*, pressing of the retaining rod 20 takes place, which generates a secondary brake force component against the displacement of the door retaining rod 20.

The thickness difference between the region 49 and the regions of the narrow side of the retaining rod adjacent thereto is approximately 8 mm. In the adjacent regions of the retaining rod 20, it just fits through the guide elements 35*a*, 35*b*, and therefore each of the two guide elements 35*a*, 35*b* has to move back by approximately 4 mm. This is achieved, on the one hand, by the elastic accommodation of the guide elements 35*a*, 35*b* on the guide part 35; on the other hand, however, a deformation of the retainer housing 30 as a whole is required for this purpose, and therefore the force required for displacing the door retaining rod is substantially elevated in relation to the force which is generated by the primary system of braking elements 50 and braking surfaces 34*a*, 34*b*. Outside the region 49, in contrast, the retaining rod 20 slides, as in door holders from the prior art, without generating a secondary braking force component through the opening 31, which is then equipped with an oversize.

For this purpose, in any case at least the region 49 and the guide elements 35*a*, 35*b* are selected from a material such that even during the numerous back-and-forth movements, the material thicknesses do not change, and therefore practically no significant change of the secondary brake force component takes place over time due to abrasion or the like. For this purpose, at least one of guide element 35*a*, 35*b* and region 49 is embodied without fiber reinforcement, since the fibers tend to treat the respective other region 49 abrasively.

It is to be noted that the guide element 35*a*, 35*b* is elastically connected to the respective guide part 35 of the retainer housing 30, and therefore the guide element 35*a*, 35*b* is pre-tensioned at the same time by a spring arrangement. However, it is also possible to arrange the guide element 35*a*, 35*b* rigidly on the guide part 35, for example, by adhesive bonding, insert molding, riveting, or the like, as will be explained in greater detail hereafter with reference to FIG. 7.

The force component generated by the guide elements 35*a*, 35*b*, when the door retaining rod 20 spreads them and/or the retainer housing 30 apart by way of the region 49, is indicated by the arrows F shown in FIG. 2.

Figure 3:
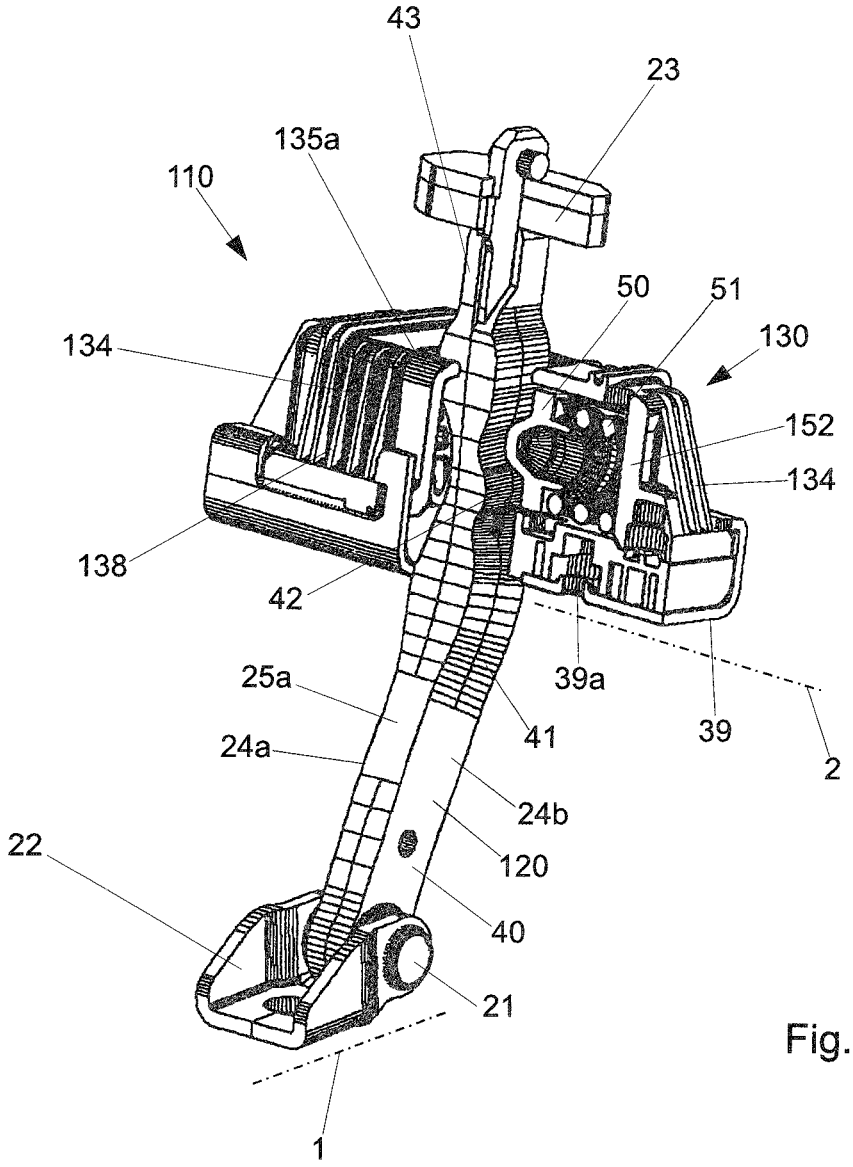
FIG. 3 shows a second preferred exemplary embodiment of a door holder according to the invention.
Figure 4:
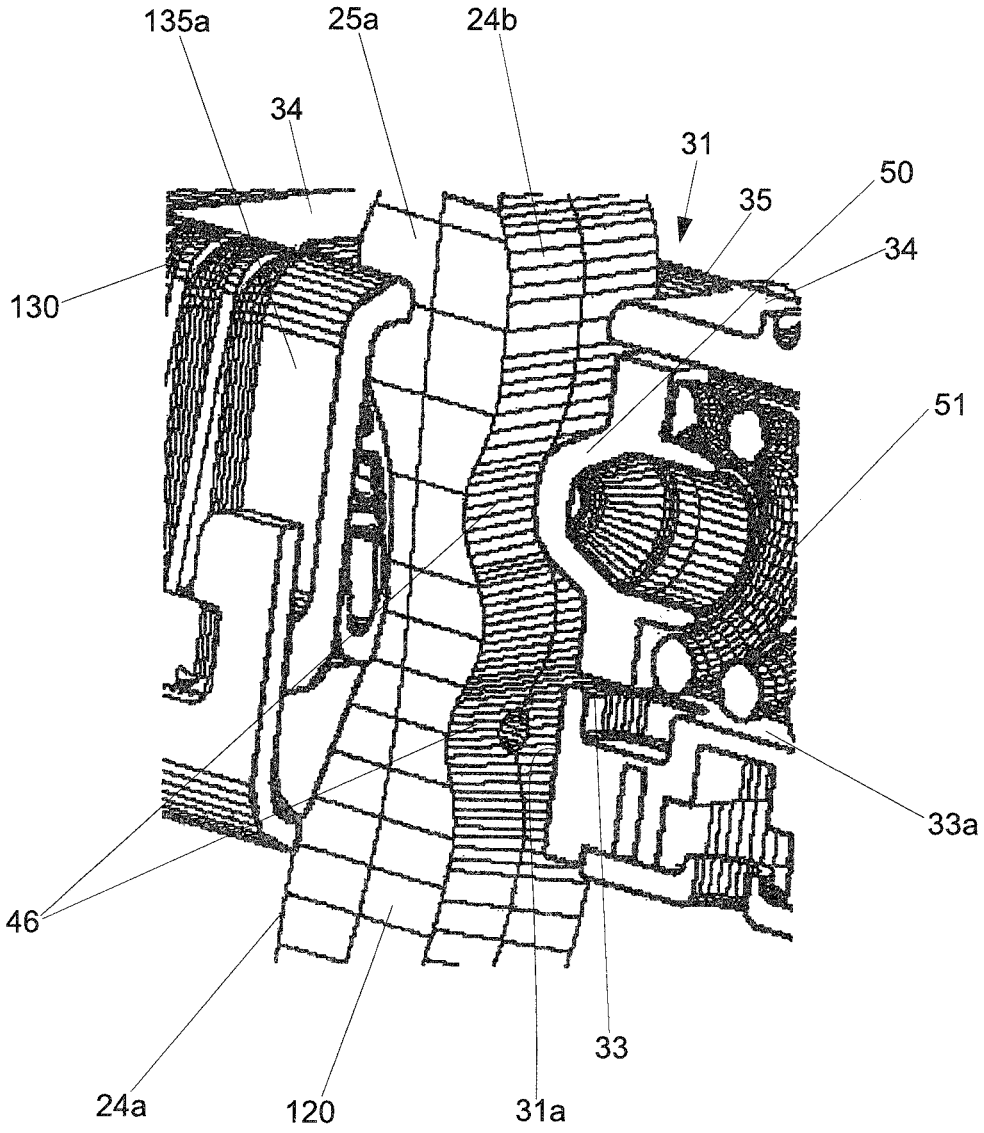
FIG. 4 shows an enlarged detail of the door holder from FIG. 3.

FIGS. 3 and 4 show a further exemplary embodiment of a door holder 110, wherein the same or structurally comparable components as in the exemplary embodiment according to FIGS. 1 and 2 have the same reference signs and components having modified features are incremented by 100 in relation to the exemplary embodiment according to FIGS. 1 and 2.

The door holder 110 is designed for a different load and has a different retaining profile than the door holder 10 from FIGS. 1 and 2. Thus, its door retaining rod 120 has multiple catch depressions 46 in the gripping section 42 thereof on the one braking surface 24*b*. The opposing side is embodied in a mirror image as the braking surface 24*a* and is not shown in all details only for better illustration of specifics. Furthermore, the retaining rod 120 has a substantially uniform width, and therefore no region 49 is provided on the guide surface 24*a*. A braking element 50, to which a spring 51, which is supported against an abutment 152, is applied, is applied in each case in a mirror image from both sides to the braking surfaces 24*a*, 24*b*. The abutment 152 is a metal plate, which is injection molded into the retainer housing 130 and which supports the spring 51 during displacement of the retaining rod 120 and pressing back of the braking elements 50.

The retainer housing 130 is also injection molded from a piece of fiber-reinforced plastic, wherein recesses 39*a* for accommodating fastening means are provided on one end face 39, which is intended for contact with the door 2.

In the region of a lateral wall 138, which is aligned approximately with the guide surface 25*a*, a guide element 135*a* formed as a slider made of plastic without fiber reinforcement is connected, wherein the slider is injection molded into the wall 138 of the retainer housing 130. While the proximal end of the guide element 135*a* is fixed, or alternatively also clamped, on the wall 138 forming an abutment, the distal end of the guide element 135*a* forms an angled end, which is engaged under tension with the guide surface 25*a* and forms a load arm. The guide element 135*a* then forms a friction pair with the guide surface 25*a*, which generates a second force component oriented against the displacement of the door retaining rod 120.

It can be seen in FIG. 4 that the guide element 135*a* overlaps approximately half of the width of the door retaining rod 120. A guide element 135*a* formed as a slider made of plastic without fiber reinforcement is expediently once again attached on the side of the mirror-image housing part 134 shown in section, and therefore two guide elements 135*a* load the guide surface 25*a*. In the same manner, two guide elements 135*b* are frictionally associated with the guide surface 25*b* on the opposing side of the retainer housing 130. The braking elements 50 and braking surfaces 24*a*, 24 again generate a primary brake force component, while the guide elements 135*a*, 135*b* and the guide surfaces 25*a*, 25*b* generate a secondary brake force component. Since the profile of the guide surfaces 25*a*, 25*b* is formed uniformly without protrusions or regions 49, the secondary brake force component is constant over the extension of the retaining rod 120.

Figure 5:
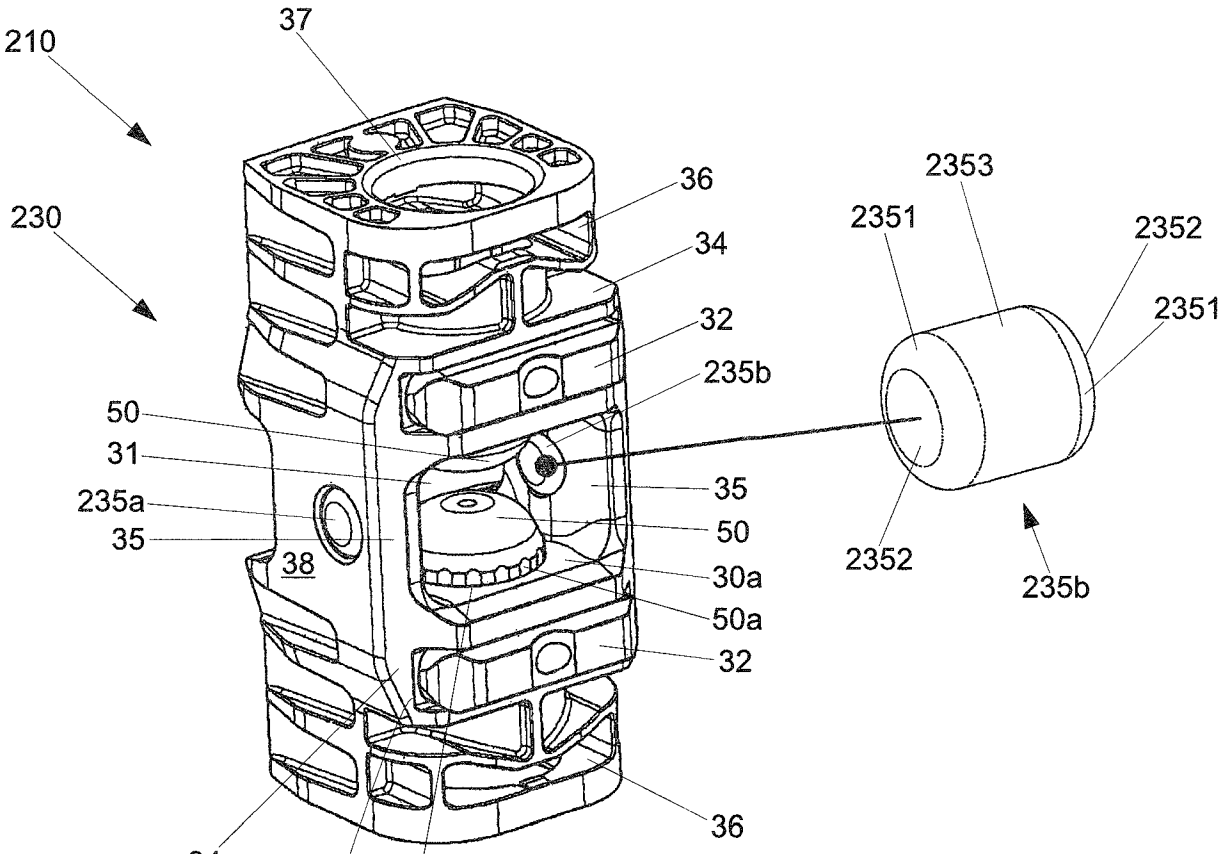
FIG. 5 shows a perspective view of a retainer housing of a further preferred exemplary embodiment of a door holder according to the invention.

FIG. 5 shows a further exemplary embodiment of a door holder 210, wherein the same or structurally comparable components as in the exemplary embodiment according to FIGS. 1 and 2 have the same reference signs and components having modified features are incremented by 200 in relation to the exemplary embodiment according to FIGS. 1 and 2. The retaining rod, which is identical to the retaining rod 20 from FIG. 1, is not shown once again. The circumferential fluting 50*a* of the braking element 50 can be seen.

The retainer housing 230 differs from the retainer housing 30 from FIGS. 1 and 2 in that the guide parts 35 each have a guide element 235*a*, 235*b* formed as a pin in the region of the saddle thereof, at half height of the opening 31, wherein the pin protrudes with its crowned tip 2351, which has a flattened central section 2352, into the opening 31, wherein the tip 2351 engages with one of the guide surfaces 25*a*, 25*b* in each case. The pin 235*a*, 235*b* is constructed symmetrically and is therefore formed identically at its two ends or tips, and therefore it can be inserted in both directions on both housing parts 35.

The pin 235*a*, 235*b* is pressed into the material of the guide parts 35 and thus fixed on the retainer housing 230. However, it is also possible to screw it in, injection mold it, adhesively bond it, or retain it in a formfitting manner using an undercut. Pressing in has the advantage that the penetration depth of the pins 235*a*, 235*b* can be calibrated depending on the application on the same retainer housing. If the pin 235*a*, 235*b* is screwed in, the corresponding borehole in the guide part 35 will be provided with a thread by the screwing in, and therefore no change of the screwing-in depth by adjustment is possible in use.

If the retaining rod 20 has a region 49, it forms a press-fit with the guide elements 235*a*, 235*b*, and therefore the retainer housing 230 has to be spread out or at least deformed so that the retaining rod is displaceable in the opening 31, whereby a secondary retaining force is generated. It can be seen that the guide element 235*a*, 235*b* is predominantly accommodated in the guide part 35, and therefore breaking out upon contact with the door retaining rod 20 is not a concern.

The opposing pins 235*a*, 235*b* are aligned with one another, and the common main axis thereof intersects the common main axis of the boreholes 33*a* accommodating the braking elements.

It is possible to furthermore equip the retainer housing 230 with a steel spring cage for further reinforcement, which additionally reduces the risk of a load fracture. If the cage encloses the tips of the pins 235*a*, 235*b* facing away from the retaining rod 20, these can even be inserted without a fixed connection into corresponding boreholes of the guide parts 35. The pin 235*a*, 235*b* is produced in each case from polyether ether ketone (PEEK), the melting point of which is not reached even upon repeated friction with the retaining rod 20.

Figure 6:
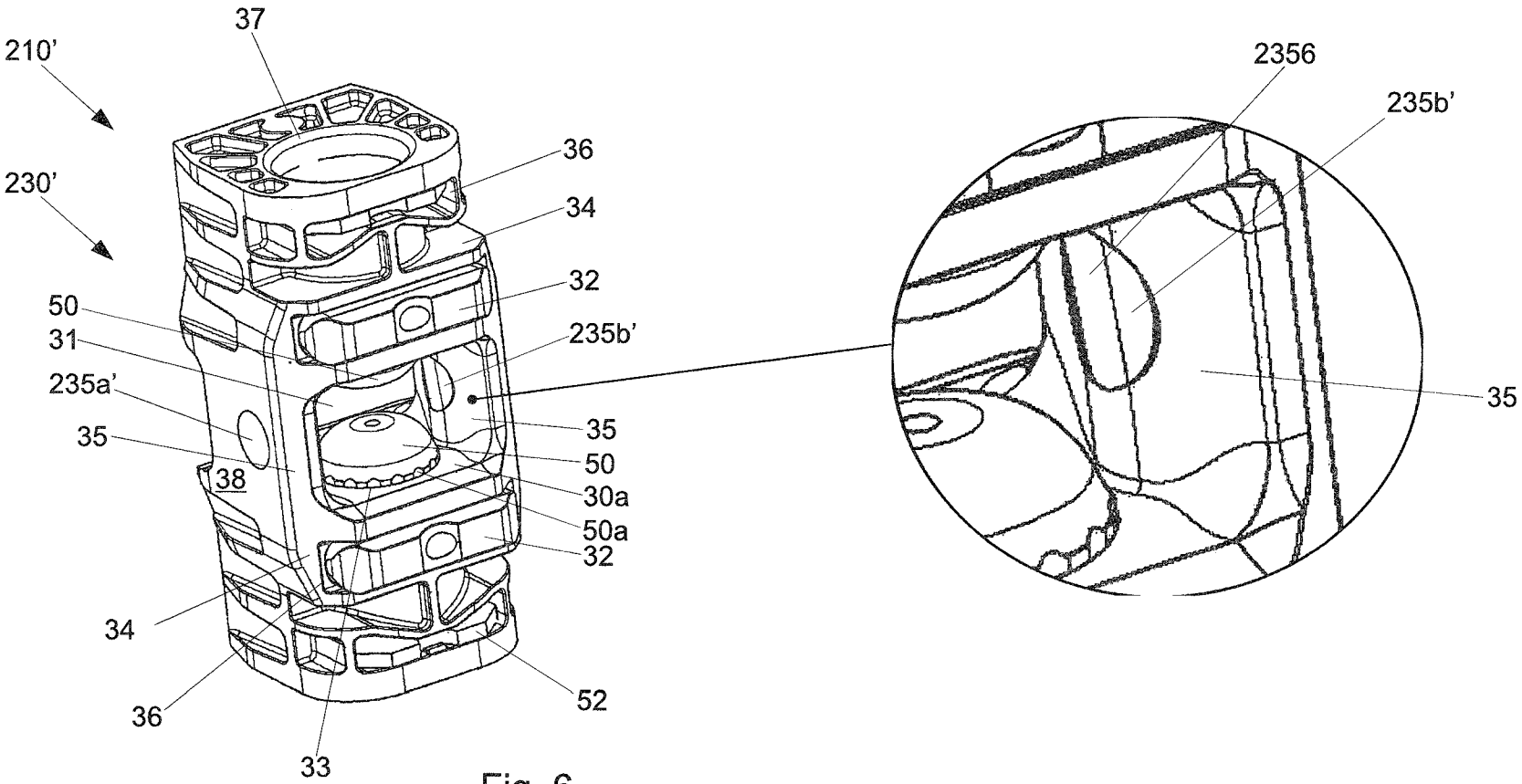
FIG. 6 shows a variant of the retainer housing from FIG. 5.

FIG. 6 shows a variant of a door holder 210', wherein the same or structurally comparable components as in the exemplary embodiment according to FIG. 5 have the same reference signs, and only the differences will be discussed. The guide elements 235*a*', 235*b*' formed as pins are injection molded into the guide parts 35 in the present exemplary embodiment, and therefore a different geometry of the pins 235*a*', 235*b*' is expedient, wherein they do not protrude out of the surface of the guide part 35 facing toward the opening 31 or the surface 38. For this purpose, the tip of the pin 235*b*' is formed having a lug 2356 aligned with the saddle of the guide part. The rear side of the pin 235*a*', 235*b*', which is not formed symmetrically, is flat and is formed flush with the surface 38.

Figure 7:
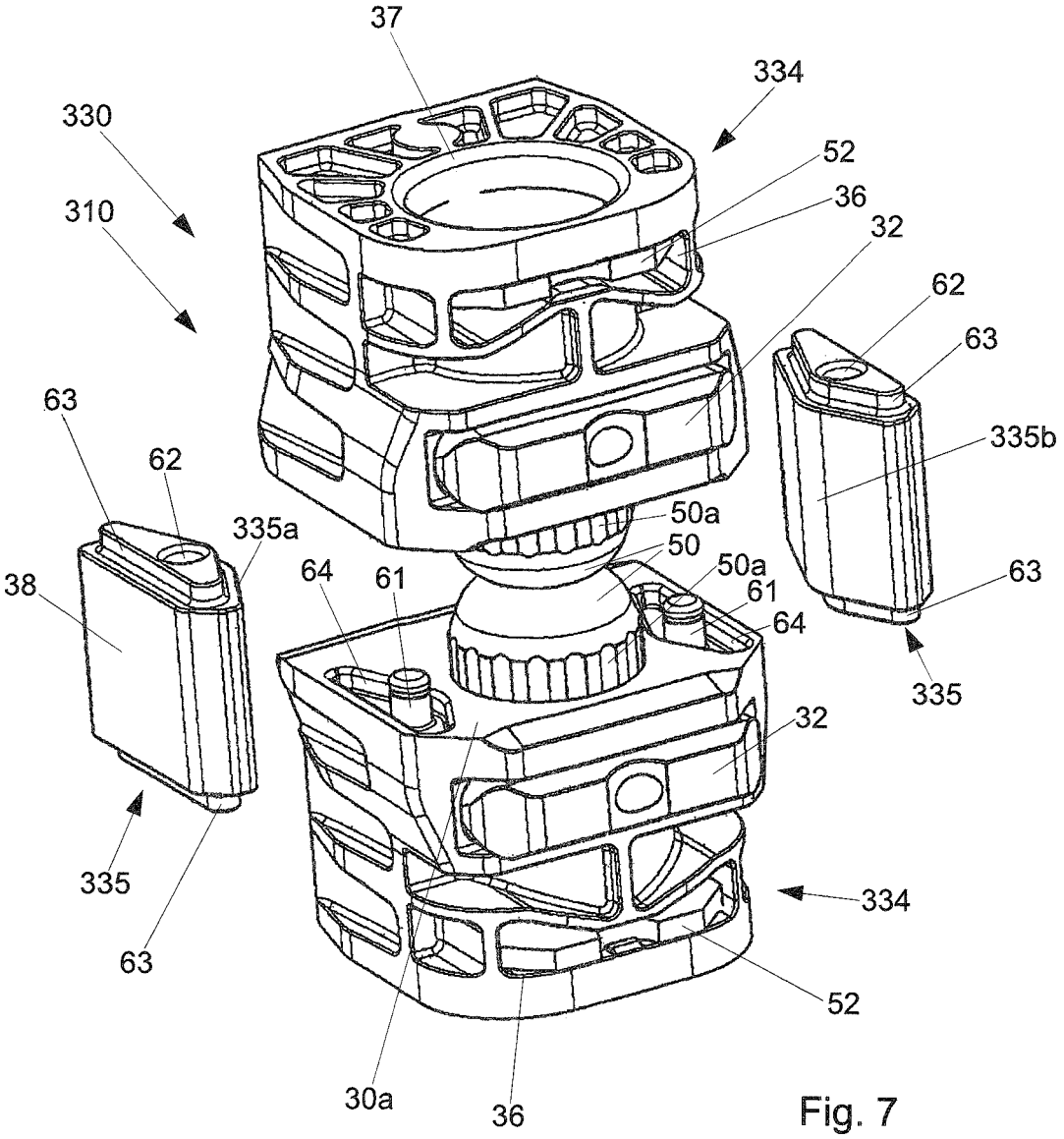
FIG. 7 shows a perspective view of a retainer housing of a further preferred exemplary embodiment of a door holder according to the invention.

FIG. 7 shows a further exemplary embodiment of a door holder 310, wherein the same or structurally comparable components as in the exemplary embodiment according to FIGS. 1 and 2 have the same reference signs and components having modified features are incremented by 300 in relation to the exemplary embodiment according to FIGS. 1 and 2. The retaining rod, which is identical to the retaining rod 20 from FIG. 1, is not shown once again. The circumferential fluting 50*a* of the braking element 50 can be seen.

In contrast to the preceding exemplary embodiments, the retainer housing 310 is not produced as a one-piece part in the plastic injection molding method, but rather has separate upper and lower housing parts 334 and guide parts 335, which jointly delimit the opening 31 for the retaining rod 20. The above-mentioned parts 334, 335, which are each formed as injection molded parts made of plastic, may be plugged together to form the retainer housing 310, wherein the housing parts 334 have protruding studs 61 made of metal, which are insertable into boreholes 62 of the guide parts 335, to reinforce the connection. Furthermore, approximately triangular projections 63 formed in one piece on the guide parts 335 can be accommodated in complementarily formed indentations 64 of the housing parts 334. It can be seen that the housing parts 334 and the guide parts 335 are identical in pairs, and therefore only two types of parts are necessary to assemble the retainer housing 310. It is possible to additionally or alternatively adhesively bond the parts 334, 335. A pin, which penetrates a borehole of the stud 61, can also be inserted as a securing splint into each of the parts 334. To provide the retainer housing 310 with the required stability, a circumferential steel spring cage is subsequently tensioned around all four parts 334, 335.

The guide element 335*a*, 335*b* is formed in the present case as in the exemplary embodiment from FIGS. 1 and 2 as a clamp, on which, however, the material of the guide part 335 was extruded in the present case. The guide element 335*a*, 335*b* is thus not movable with respect to the guide part 335. However, it is also possible to form the guide element on the guide part 335 as in one of the other exemplary embodiments.

Figure 8:
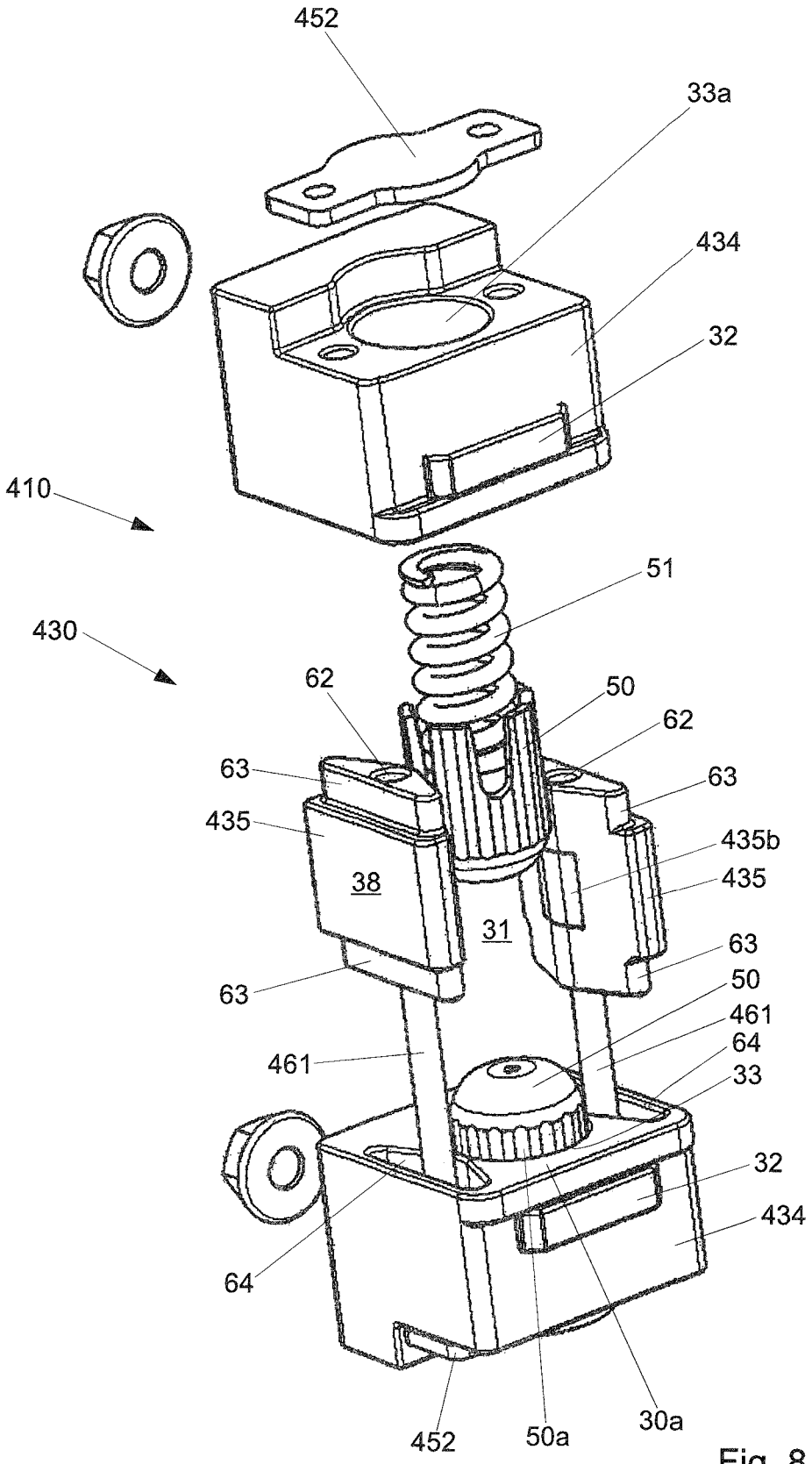
FIG. 8 shows a perspective view of a retainer housing of a still further preferred exemplary embodiment of a door holder according to the invention.

FIG. 8 shows a further exemplary embodiment of a door holder 410, wherein the same or structurally comparable components as in the exemplary embodiment according to FIG. 7 have the same reference signs and components having modified features are incremented by 100 in relation to the exemplary embodiment according to FIG. 7. The retaining rod, which is identical to the retaining rod 20 from FIG. 1, is not shown once again.

It can be seen that the retainer housing 430 can again be assembled from two housing parts 434 and two guide parts 435, wherein instead of the projections 61, continuous studs 461 couple the two housing parts 434 and one of the two guide parts 435 in each case to one another, which are each riveted on the abutment plate 452.

The stud 461 also penetrates in this case a guide element 435*a*, 435*b*, which is formed as a hollow pin and is injection molded in the respective guide part 35. The radial circumferential surface of the guide element 435*a*, 435*b* aligns with the surface of the guide part 435 facing toward the opening 31 and forms a friction pair with the guide surface 25*a*, 25*b* of the retaining rod 20, wherein the studs 461 form a type of pre-tensioned spring. The studs 461 thus absorb the majority of the loads generated by the deformation of the retainer housing 430.

Figure 9:
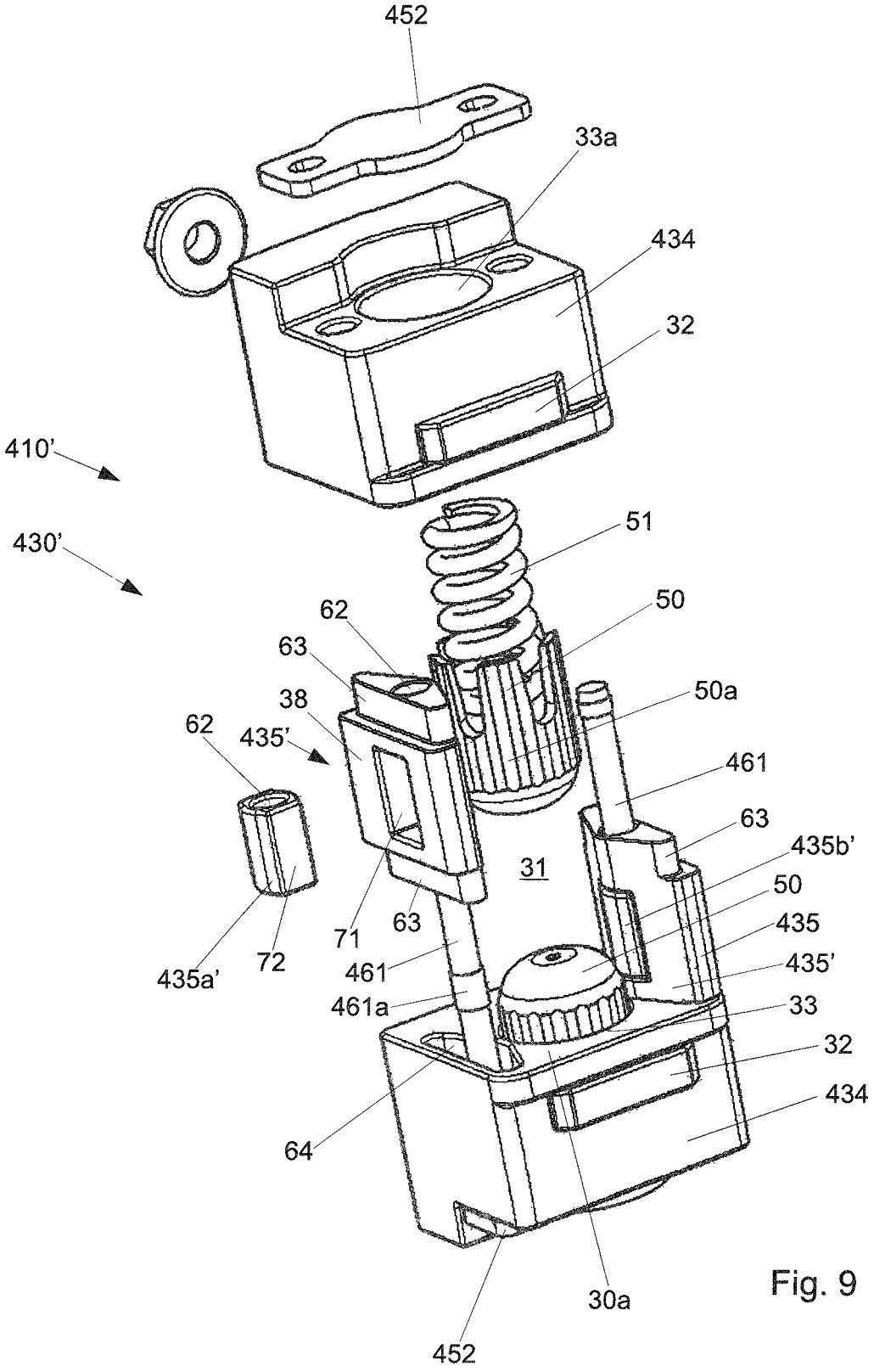
FIG. 9 shows a variant of the retainer housing from FIG. 8.

FIG. 9 shows a variant of the retainer housing 430' from FIG. 8, and therefore the same reference signs as in FIG. 8 identify the same or structurally comparable parts.

In contrast to FIG. 8, the guide element 435*a*' is not injection molded in the guide part 35, but rather can be inserted with opposing flat sides 72 in a recess 71 of the surface 38. A thickening 461*a* on the stud 461 holds the guide element 435*a*', 435*b*' with a press-fit in its borehole 62. The guide element 435*a*', 435*b*' also has, in addition to its opposing flat sides 72, two engagement rounded areas on its circumference, which protrude somewhat out of the side of the guide part 435 facing toward the opening 31 or at least delimit the opening 31, by extending flush with the side of the guide part 435 facing toward the opening 31. It is also possible to form the thickening 461*a* and the borehole 62 in each case with a prismatic cross section, whereby a twist lock would be provided between stud 461 and guide element 435*a*', 435*b*'. If the recesses 71 then have play in relation to the flat sides 72, forces introduced through the guide surfaces are substantially absorbed by the stud 62, and therefore the risk of fracture is reduced for the retainer housing 430'. It is also possible to attach an axially protruding pin like the pin 235*a*, 235*b* from FIG. 5 to the stud 62.

Figure 10:
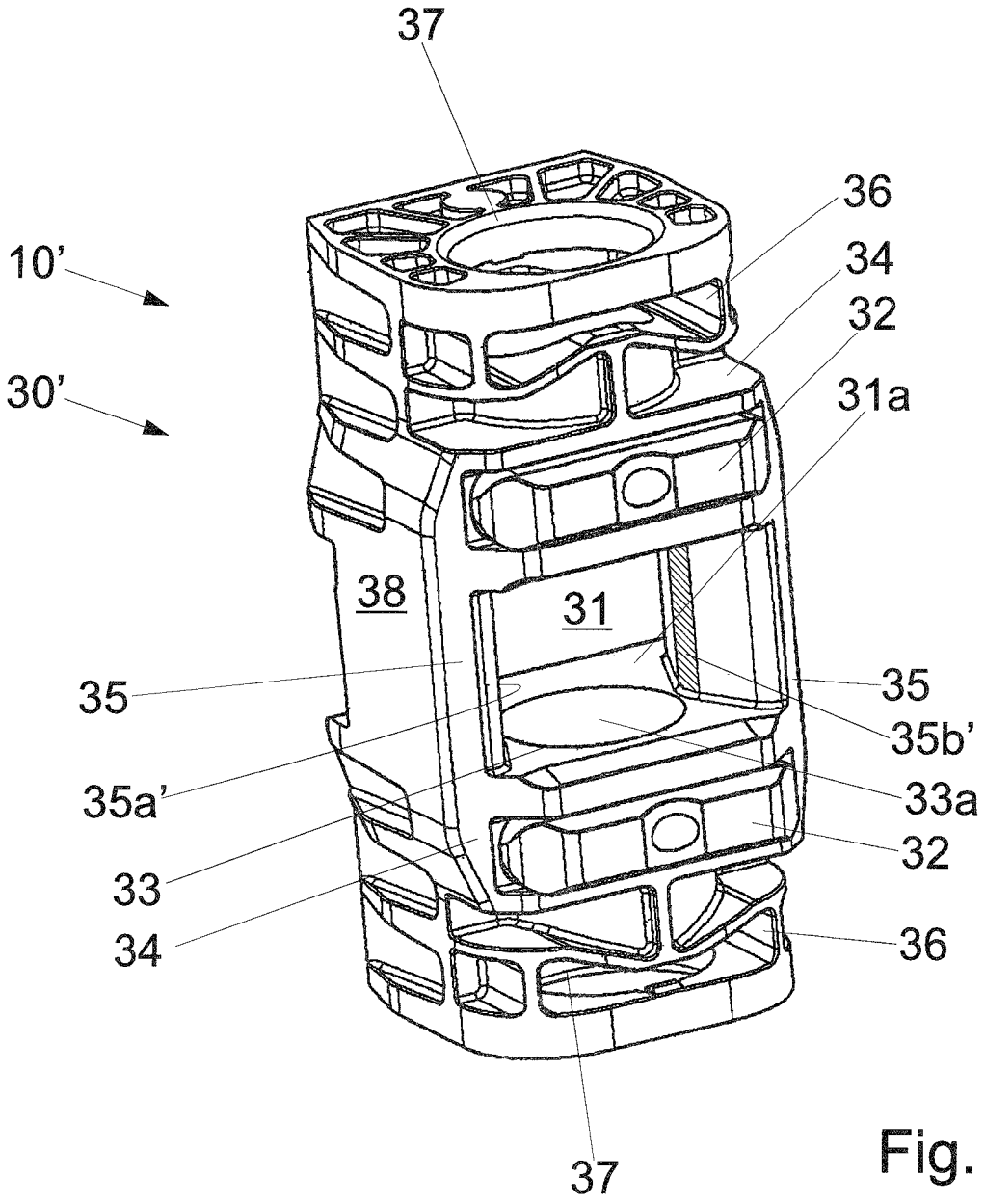
FIG. 10 shows a variant of the retainer housing from FIGS. 1 and 2.

FIG. 10 shows a variant of the retainer housing 30' from FIGS. 1 and 2, and therefore the same reference signs as in FIGS. 1 and 2 identify the same or structurally comparable parts.

In contrast to the guide elements 35*a*, 35*b* from FIGS. 1 and 2, which are formed as a panel part, the guide element 35*a*', 35*b*' is implemented in the present case by a surface region which spans the entire height of the opening 31 and is formed rigidly on the guide part 35. The surface region 35*a*', 35*b*' is produced in the present case by insert molding a thin-walled bracket-like section on the guide part 35, but can also be formed as a pin embedded at this point or as an applied film. Furthermore, the surface regions 35*a*', 35*b*' can be tempered by treating the surface using thermal or chemical processes. It is also possible to form a section of the guide part 35 containing the surface regions 35*a*', 35*b*' from the material of the surface regions 35*a*', 35*b*', in the present case non-fiber-reinforced PEEK.

The surface region 35*a*', 35*b*' is advantageously not rigidly connected with respect to the guide parts 35 of the retainer housing 30' and therefore in contrast to the panel parts 35*a*, 35*b* from FIGS. 1 and 2, is also not movable in relation thereto, whereby the counterforce for the spreading apart by the regions 49 of the door retaining rod 20 is provided by the system defined by the retainer housing 30'. Furthermore, the retainer housing 30' can be formed narrow in the region of the guide parts, and therefore the mass of the retainer housing 30' and the required installation space in the door 2 are dimensioned small.

The retainer housing 30' differs from retainer housings produced from plastic from the prior art by way of the dedicated surface regions 35*a*', 35*b*', which can generate a brake force component.

Furthermore, in retainer housings produced in one piece, the transition region from the guide parts 35 to the housing parts 34 can be formed having a fiber reinforcement, which better absorbs the tensile stresses generated by the press-fit of the guide surfaces 25*a*, 25*b* and the guide elements 35*a*, 35*b*, which can be critical in plastic parts, and deflects somewhat.

The function of the door holder is the same in principle in all exemplary embodiments. The design of the primary brake force component and the secondary brake force component is substantially carried out by the embodiment of the sections and regions of the retaining rod. Each retainer housing can thus be used for various door retaining characteristics if only the retaining rod is adapted.

The invention has been explained above on the basis of various exemplary embodiments of guide elements and retainer housings. It has to be understood that every retainer housing can be combined in principle with any of the described guide elements, and these combinations are also part of the disclosure of the present application.

The invention has been explained above on the basis of exemplary embodiments, in which the braking surfaces of the door retaining rod have a mirror-image profile, i.e., ramp sections, etc. are provided in each case on both braking surfaces. It has to be understood that it is also possible that only one of the two braking surfaces has such a profile, while the other is formed essentially smooth. In this case, it is also not necessary for the braking element facing toward the profiling to be adjustable movably to this profile pre-tensioned by a spring. The end of the retainer housing opposite to the braking element can then be embodied as a planar support surface, or also as a locally variable or as an axially adjustable braking element.

The invention has been described above on the basis of exemplary embodiments in which the braking surface is formed on the wide side of the retaining rod and the guide surface is formed on the narrow side of the retaining rod. It has to be understood that this can also be provided inversely, and in particular the retaining rod can also have an approximately square profile, in which the extensions of braking surface and guide surface are approximately equal.

The invention has been explained above on the basis of exemplary embodiments, in which the braking element is axially displaceable in a longitudinal guide embodied as a borehole. It has to be understood that the braking element can also be adjusted differently in the direction toward the braking surface, for example, by a braking element linked on the retainer housing, which is pivoted about its linking axis and forms a brake shoe. A roller to which a torsion spring is applied or a ball held in a socket also come into consideration.

The invention has been explained above on the basis of exemplary embodiments in which the retainer housing is produced either as a one-piece part from fiber-reinforced plastic in the injection-molding method or is assembled from two guide parts and two housing parts. It has to be understood that one guide part can also be integrally formed in each case with a housing part, and therefore two units each formed from one guide part and one housing part, in particular units formed as point-symmetrical and/or identical, can be provided for the assembly of the retainer housing.

The invention has been explained above on the basis of exemplary embodiments which have guide elements that are fixed in the guide parts or are only slightly movable and are formed as slides or sliding surfaces, on which the guide surfaces slide to generate a particularly high secondary brake force component. It has to be understood that it is also possible to provide rotatably mounted guide parts, along which the guide surfaces roll, on the guide parts or in bolts or studs provided therein.

The invention has been explained above on the basis of exemplary embodiments, in which the parts of the retainer housing are produced from plastic. It has to be understood that the parts of the retainer housing can also be formed from metal, which are either connected to the further parts by riveting or onto which the plastic material is insert molded.

The invention has been explained above on the basis of exemplary embodiments in which the braking element has a hemispherical or crowned configuration. It has to be understood that in the same manner the braking element can also have a lug-shaped end face, which can advantageously engage together with depressions as shown in FIG. 3.

The invention has been explained above on the basis of exemplary embodiments in which a guide element is arranged on each guide part of the retainer housing. It has to be understood that multiple guide elements arranged adjacent to one another in the movement direction of the retaining rod can also be provided on each guide part. The two opposing arrangements of guide elements can then be arranged both in a mirror image and also offset by half a division in the displacement direction of the retaining rod, in the case of which one protruding guide element is arranged centrally between two opposing protruding guide elements.

The invention has been explained above on the basis of exemplary embodiments in which the surface 38 of the guide part 35 facing away from the guide elements approximately aligns with the lateral wall of the housing parts 34. It has to be understood that the guide parts can also comparably form a housing part 34, and therefore the guide elements can also be loaded by a spring in the axial direction and can be embodied as axially displaceable and the retainer housing is formed essentially like a plus sign.

The invention has been explained above on the basis of exemplary embodiments in which the door retaining rod has a first and a second guide surface. It has to be understood that the door retaining rod furthermore can have a third and fourth guide surface if, for example, the cross section of the door retaining rod is hexagonal. It is possible in this case to have every or only individual ones of the guide surfaces interact with a guide element.

What is claimed is:

1. A door holder, comprising a retainer housing, which is connectable to one of a door and a door frame; and a door retaining rod, which penetrates the retainer housing and can be articulated with the other of the door and the door frame, wherein the door retaining rod comprises at least one braking surface, wherein at least one braking element displaceable in a direction of the at least one braking surface is arranged on the retainer housing, wherein the at least one braking element can be brought into contact at least in sections with the at least one braking surface of the door retaining rod and thus generates a primary brake force component against a displacement of the door retaining rod, wherein the door retaining rod comprises at least one guide surface inclined in relation to the braking surface, wherein at least one guide element is arranged on the retainer housing, wherein the at least one guide element can be brought at least in regions into contact with the at least one guide surface and generates a secondary brake force component against the displacement of the door retaining rod, wherein the guide element is formed as a pin, and wherein the pin is accommodated in a guide part of the retainer housing, wherein a radial circumferential surface of the pin protrudes into the opening to at least delimit an opening of the retainer housing, wherein the pin comprises a borehole, wherein the borehole is penetrated by a stud made of metal, and wherein an outer circumference of the pin facing away from the stud cooperates with the guide surface.

2. The door holder as claimed in claim 1, wherein the at least one guide element is formed from plastic.

3. The door holder as claimed in claim 2, wherein the plastic comprises PEEK.

4. A door holder, comprising:

a retainer housing, which is connectable to one of a door and a door frame; and a door retaining rod, which penetrates an opening of the retainer housing and can be articulated with the other of the door and the door frame, wherein the door retaining rod comprises at least one braking surface, wherein at least one braking element displaceable in a direction of the at least one braking surface is arranged on the retainer housing, wherein the at least one braking element can be brought into contact at least in sections with the at least one braking surface of the door retaining rod and thus generates a primary brake force component against a displacement of the door retaining rod, wherein the door retaining rod comprises at least one guide surface inclined in relation to the braking surface, wherein at least one guide element is arranged on the retainer housing, wherein the at least one guide element can be brought at least in regions into contact with the at least one guide surface and generates a secondary brake force component against the displacement of the door retaining rod, wherein the guide element is formed as a pin, wherein the pin is accommodated in a guide part of the retainer housing facing the at least one guide surface, and wherein an end face of the pin ending in the opening points toward the at least one guide surface.

5. The door holder as claimed in claim 4, wherein the at least one guide element is free of reinforcing fibers in the region of its contact with the guide surface.

6. The door holder as claimed in claim 4, wherein an end face of the pin is oriented axially into the opening of the retainer housing.

7. The door holder as claimed in claim 4, wherein the guide element is tensioned toward the guide surface.

8. The door holder as claimed in claim 4, wherein the at least one breaking surface is two braking surfaces facing away from one another, and the at least one guide surface is two guide surfaces facing away from one another.

9. The door holder as claimed in claim 8, wherein the at least one braking element includes two braking elements and the at least one guide element includes two guide elements, wherein each of the two braking surfaces can be brought into contact with one of the braking elements, and wherein each of the two guide surfaces can be brought into contact with one of the guide elements, respectively.

10. The door holder as claimed in claim 9, wherein the guide elements oppose one another and define a shortest connecting straight line which intersects the displacement axis of the braking elements opposing one another such that the two lines span a plane.

11. The door holder as claimed in claim 4, wherein the pin is received in a borehole of the retainer housing.

12. The door holder as claimed in claim 11, wherein the borehole has an axis which extends perpendicularly to a displacement axis of the at least one displaceable braking element.

13. The door holder as claimed in claim 4, wherein the pin comprises a rounded end face, which facilitates the sliding along the guide surface.

14. The door holder as claimed in claim 4, wherein the pin is connected to the guide part by one of injection molding and screwing.

15. The door holder as claimed in claim 4, wherein the at least one braking element is pre-tensioned by a spring in the direction of the at least one braking surface, and wherein the at least one braking surface has a height profile extending unevenly in the height over the course of the door retaining rod, and wherein with increasing height of the height profile, the spring of the at least one braking element is increasingly tensioned.

16. The door holder as claimed in claim 4, wherein the guide element is provided on a separate guide part of the retainer housing, and wherein the separate guide part can be assembled with further individual parts of the retainer housing to form the retainer housing.

17. A door holder, comprising a retainer housing, which is connectable to one of a door and a door frame; and a door retaining rod, which penetrates an opening of the retainer housing and can be articulated with the other of the door and the door frame, wherein the door retaining rod comprises at least one braking surface, wherein at least one braking element displaceable toward the at least one braking surface is provided on the retainer housing, wherein the at least one braking element can be brought into contact at least in sections with the at least one braking surface of the door retaining rod to generate a primary brake force component against a displacement of the door retaining rod, wherein the door retaining rod comprises at least one guide surface substantially perpendicular to the braking surface, wherein at least one guide element is arranged on the retainer housing, wherein the at least one guide element can be brought into contact with the at least one guide surface to generate a secondary brake force component against the displacement of the door retaining rod, wherein the guide element is configured as an axial pin, wherein the pin is accommodated in a borehole of a guide part of the retainer housing facing the at least one guide surface to narrow a passage width for the door retaining rod compared to an opening width, wherein the guide surface of the door retaining rod comprises a widened region, and wherein the widened region of the guide surface spreads the guide part of the retainer housing with the pin accommodated therein apart, when the widened region passes along the guide element.

18. The door holder as claimed in claim 17, wherein the at least one guide surface includes two guide surfaces facing away from one another, wherein the at least one guide element includes two opposing guide elements arranged on the retainer housing, which can each be brought into contact at least in some regions with the two guide surfaces facing away from one another, and that the two guide surfaces have an oversize in relation to the two guide elements at least in a region.

* * * * *